US008197362B1

(12) United States Patent
Johnson

(10) Patent No.: US 8,197,362 B1
(45) Date of Patent: Jun. 12, 2012

(54) BASKETBALL FREE THROW PRACTICE GUIDE

(76) Inventor: Joe Johnson, Los Angeles, CA (US)

( * ) Notice: Subject to any disclaimer, the term of this patent is extended or adjusted under 35 U.S.C. 154(b) by 15 days.

(21) Appl. No.: 12/886,615

(22) Filed: Sep. 21, 2010

(51) Int. Cl.
*A63B 69/00* (2006.01)

(52) U.S. Cl. ..... 473/447; 473/422

(58) Field of Classification Search ..... 473/422, 473/446, 447, 438, 462, 448, 439, 480; 273/348, 273/392
See application file for complete search history.

(56) References Cited

U.S. PATENT DOCUMENTS

| | | | | | |
|---|---|---|---|---|---|
| 2,039,794 | A | | 5/1936 | Hayden et al. | |
| 4,206,915 | A | | 6/1980 | Woodcock | |
| 4,226,416 | A | * | 10/1980 | Callanan | 473/448 |
| 4,245,843 | A | * | 1/1981 | Griggs | 473/446 |
| 4,506,886 | A | * | 3/1985 | Lamb, Sr. | 473/447 |
| 4,696,471 | A | * | 9/1987 | McGrath et al. | 473/462 |
| 4,842,283 | A | * | 6/1989 | LeBel et al. | 273/392 |
| D303,824 | S | * | 10/1989 | Maloney, II | D21/699 |
| 4,911,442 | A | * | 3/1990 | Monroe et al. | 473/462 |
| 5,354,048 | A | * | 10/1994 | Winesberry, Jr. | 473/447 |
| D368,942 | S | | 4/1996 | Mahoney | |
| 5,628,515 | A | * | 5/1997 | Levy | 473/446 |
| 5,800,290 | A | | 9/1998 | Barry | |
| 5,813,926 | A | * | 9/1998 | Vance | 473/448 |
| 6,190,270 | B1 | * | 2/2001 | Barry | 473/438 |
| 6,322,460 | B1 | * | 11/2001 | Asci | 473/422 |
| 6,375,585 | B1 | * | 4/2002 | Driscoll | 473/477 |
| 6,458,050 | B2 | * | 10/2002 | Barry | 473/438 |
| 6,932,723 | B1 | | 8/2005 | Klinger et al. | |
| 7,090,596 | B2 | * | 8/2006 | David | 473/439 |
| 7,134,976 | B1 | * | 11/2006 | Smith | 473/446 |
| 7,351,168 | B1 | * | 4/2008 | Pannell | 473/476 |
| 7,427,244 | B1 | * | 9/2008 | Patel | 473/448 |
| 2003/0199342 | A1 | * | 10/2003 | Birss | 473/446 |
| 2004/0043841 | A1 | | 3/2004 | Williams | |
| 2010/0261558 | A1 | * | 10/2010 | Heflin, Sr. | 473/448 |
| 2012/0046134 | A1 | * | 2/2012 | Heystek et al. | 473/447 |

* cited by examiner

*Primary Examiner* — Mitra Aryanpour
(74) *Attorney, Agent, or Firm* — Kyle Fletcher

(57) ABSTRACT

The Basketball free throw practice guide includes a flag that extends vertically from an assembly that attaches onto a basketball rim. The assembly includes a flag base, support, and main base that inter-connect via a bolt or screw. The main base has a groove that is sealed off via the flag base to enclose the cross-section of the basketball rim therein. The assembly is weighted and self-ballasts when installed upon said basketball rim such that the flag will return to a vertical position upon impact by an object such as a basketball. The flag acts as a guide to teach proper basketball trajectory into the basketball rim.

20 Claims, 4 Drawing Sheets

BASKETBALL FREE THROW PRACTICE GUIDE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of basketball, more specifically, a basketball rim accessory that is designed to train an end user in practicing free-throw shots.

B. Discussion of the Prior Art

As will be discussed immediately below, no prior art discloses a basketball free throw practice guide that involves a basketball rim accessory that temporarily attaches itself upon said basketball rim and of which a flag extends vertically there from to teach proper basketball arch and trajectory into said basketball rim; wherein the device has a weighted bottom portion of the bracket that will right the flag between engagement by a basketball so as to reset the flag to a vertical position with respect to the basketball rim.

The Williams Patent Application Publication (U.S. Pub. No. 2004/0043841) discloses a knockdown device that attaches to the front of a basketball rim and will block or deflect a ball entering the rim if the arch is not high enough. However, the knockdown device does not right itself after being impacted by a basketball as does the self-ballasting device being currently claimed.

The Klinger Patent (U.S. Pat. No. 6,932,723) discloses a basketball shooting accuracy device that attaches to the rim and will prevent a ball from entering the rim if the angle of the shot is not at the proper arch. However, the shooting device rests atop the entire periphery of the basketball rim and does not attach onto the basketball rim via an assembly that self-ballasts the flag extending vertically therefrom.

The Hayden Patent (U.S. Pat. No. 2,039,794) discloses a practicing device that detachably attaches to the front of a basketball rim and teaches proper shooting angles. However, the device does not rotate about the rim, but merely rests atop said rim and presents a hoop at an angle through which a basketball shall pass.

The Berry Patent (U.S. Pat. No. 5,800,290) discloses a basketball shooting aid practice device that attaches to the front of the rim and will bend or pivot if the ball strikes it, showing that the ball is at the wrong angle to enter the rim properly. However, the device does not restore itself to an upright position, and in fact stays in said position until restored via an exterior force.

The Woodcock Patent (U.S. Pat. No. 4,206,915) discloses a basketball shot practice apparatus in which attachments on the front of the rim will teach proper shot arch. However, the apparatus extends a plurality of attachments radially away from the rim, as opposed to a device that simply attaches upon said rim and of which self-ballasts itself to a vertical position after impact by a basketball.

The Mahoney Patent (U.S. Pat. No. Des. 368,942) illustrates a design for a basketball shot improving attachment for a rim, which does not depict an assembly that self-ballasts.

While the above-described devices fulfill their respective and particular objects and requirements, they do not describe a basketball free throw practice guide that involves a basketball rim accessory that temporarily attaches itself upon said basketball rim and of which a flag extends vertically there from to teach proper basketball arch and trajectory into said basketball rim; wherein the device has a weighted bottom portion of the bracket that will right the flag between engagement by a basketball so as to reset the flag to a vertical position with respect to the basketball rim. In this regard, the Basketball free throw practice guide departs from the conventional concepts and designs of the prior art.

SUMMARY OF THE INVENTION

The Basketball free throw practice guide includes a flag that extends vertically from an assembly that attaches onto a basketball rim. The assembly includes a flag base, support, and main base that inter-connect via a bolt or screw. The main base has a groove that is sealed off via the flag base to enclose the cross-section of the basketball rim therein. The assembly is weighted and self-ballasts when installed upon said basketball rim such that the flag will return to a vertical position upon impact by an object such as a basketball. The flag acts as a guide to teach proper basketball trajectory into the basketball rim.

It is an object of the invention to provide a basketball free throw practice guide that attaches upon the rim of a basketball goal and of which aids in teaching the proper basketball trajectory.

A further object of the invention is to provide an assembly that can attach onto or detach from the basketball rim.

A further object of the invention is to provide an assembly, which is weighted and will self ballast itself after being impacted by a basketball.

These together with additional objects, features and advantages of the Basketball free throw practice guide will be readily apparent to those of ordinary skill in the art upon reading the following detailed description of presently preferred, but nonetheless illustrative, embodiments of the Basketball free throw practice guide when taken in conjunction with the accompanying drawings.

In this respect, before explaining the current embodiments of the Basketball free throw practice guide in detail, it is to be understood that the Basketball free throw practice guide is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the Basketball free throw practice guide.

It is therefore important that the claims be regarded as including such equivalent construction insofar as they do not depart from the spirit and scope of the Basketball free throw practice guide. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
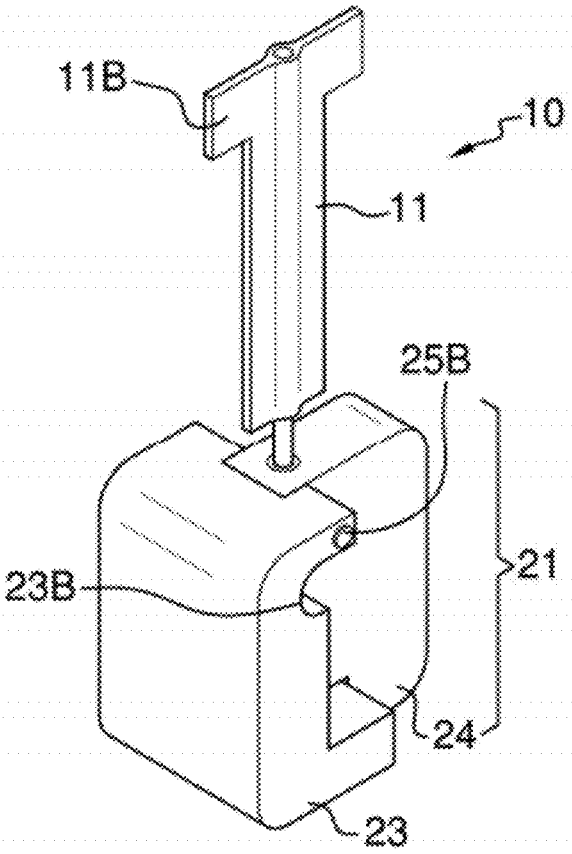
FIG. 1 illustrates a top, isometric view of the Basketball free throw practice guide wherein the flag is in a vertical position.
Figure 2:
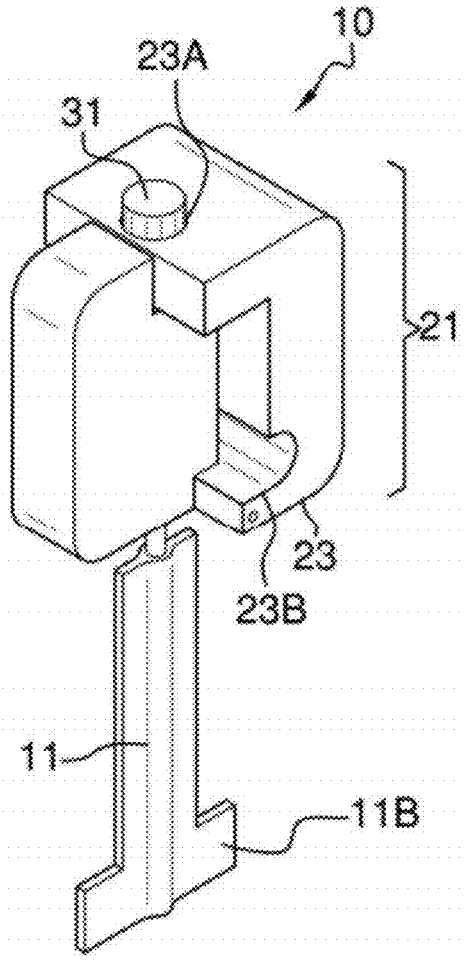
FIG. 2 illustrates a bottom, view of the Basketball free throw practice guide.
Figure 3:
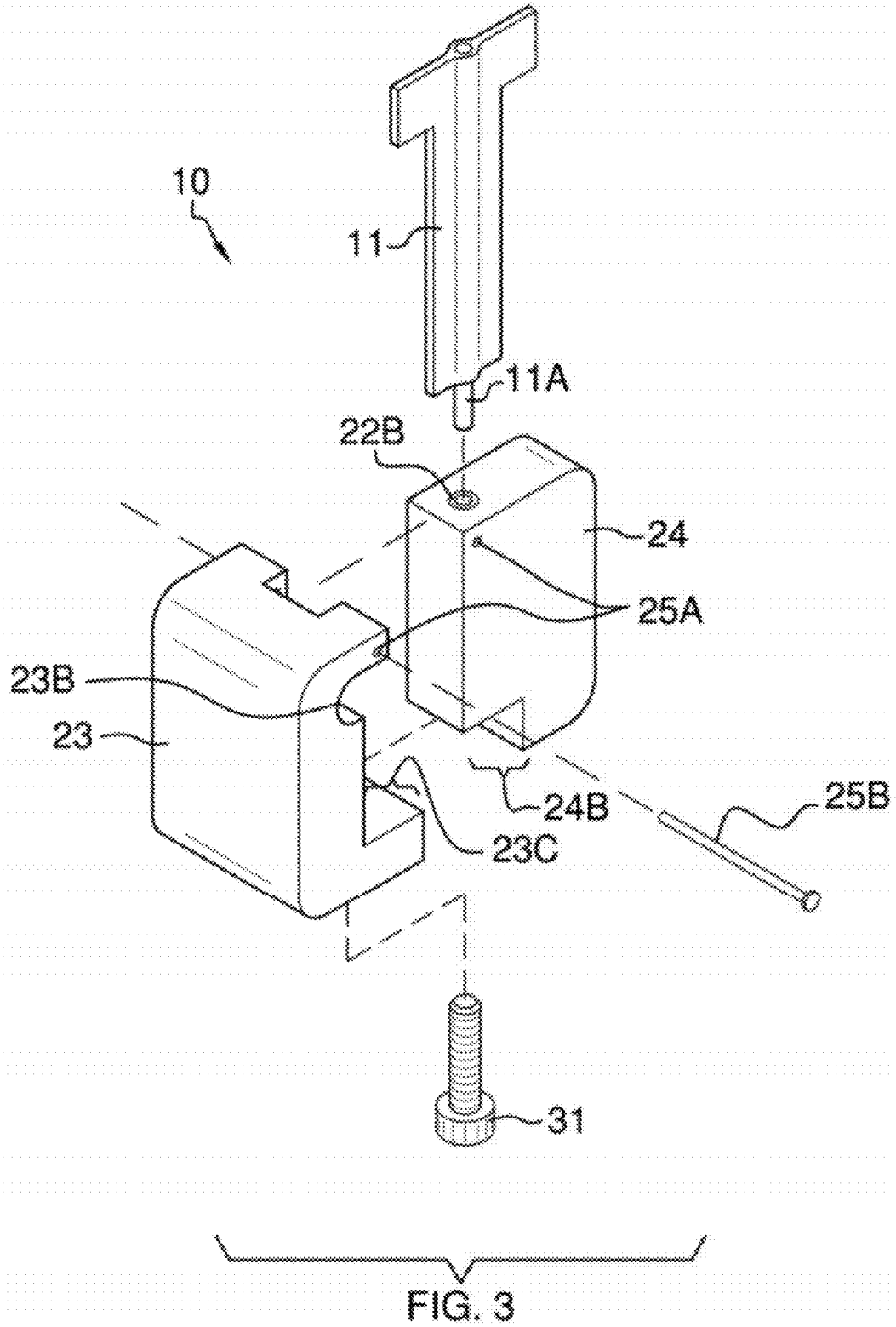
FIG. 3 illustrates an exploded view of the Basketball free throw practice guide, and detailing the alignment of the flag above the flag base, and the flag base aligned with the support and main base, and detailing alignment of the screw or bolt to the support.
Figure 4:
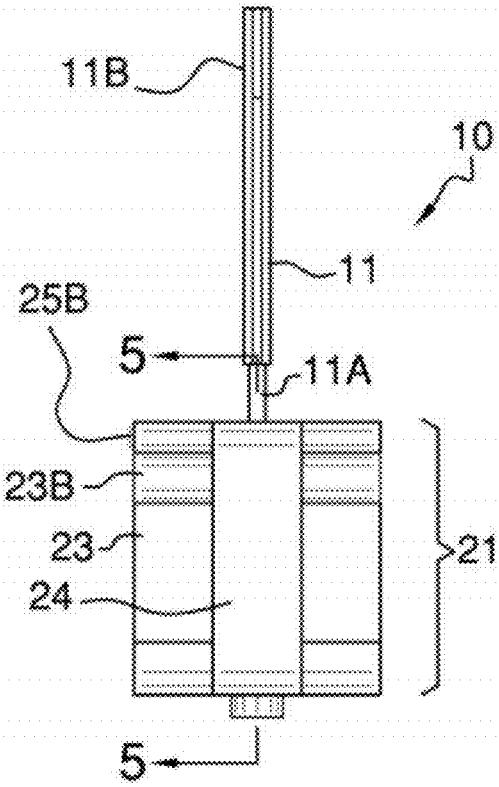
FIG. 4 illustrates a side view of the Basketball free throw practice guide assembled.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A basketball free throw practice guide 10 (hereinafter invention) includes a flag 11, an assembly 21 further comprising a main base 23, a flag base 24, and an attaching means 31.

The flag 11 extends from the assembly 21 in a vertical orientation, and more specifically, extends from the flag base 22. The attaching means 31 is responsible for keeping the assembly 21 assembled.

The main base 23 has a threaded hole 23A through which the attaching means 31 enters. The main base 23 also has a groove 23B that accommodates a basketball rim 60 therein (see FIGS. 5-6). The groove 23B is enclosed when the assembly 21 is assembled, and the flag base 24 is adjacent the groove 23B of the main base 23.

Figure 5:
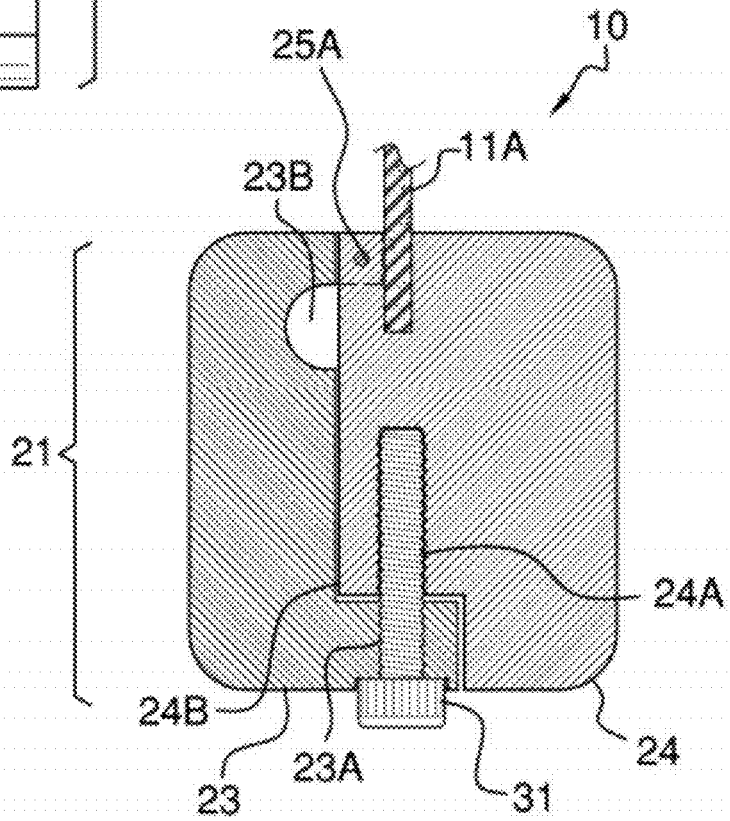
FIG. 5 illustrates a cross-sectional view of the Basketball free throw practice guide along line 5-5 in FIG. 4 and detailing the inter-relation of the assembly.
Figure 6:
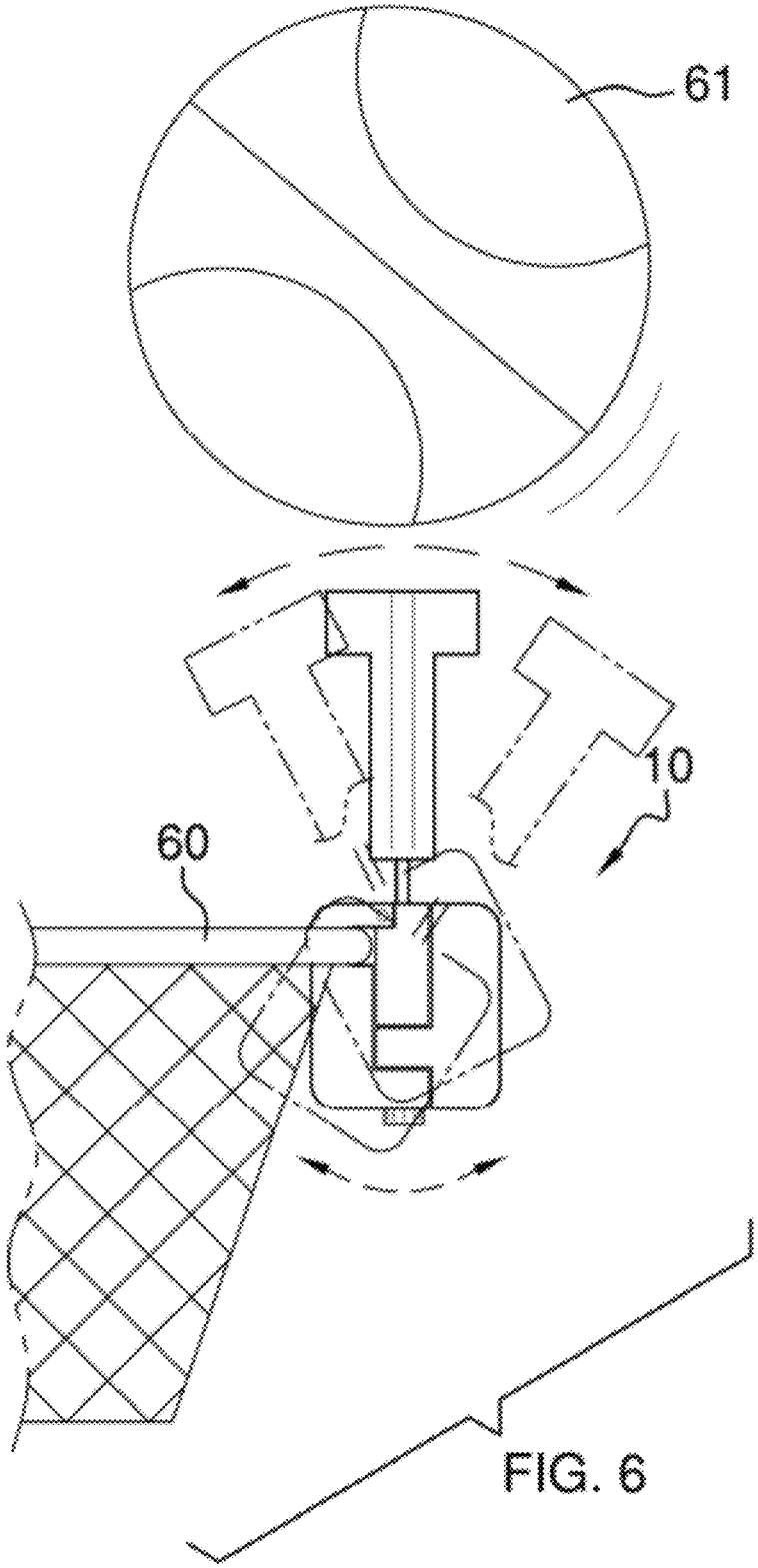
FIG. 6 illustrates a view of the Basketball free throw practice guide installed on a basketball rim and detailing movement of the flag thereon.

The flag base 24 has a threaded hole 24A through which the attaching means 31 enters after passing through the main base 23 (see FIG. 5). It shall be noted that the threaded holes 23A and 24A are located on a bottom surface of the main base 23 and the flag base 24, respectively.

The flag base 24 has a threaded hole 24A through which the attaching means 31 enters into in order to secure the entire assembly 21 together, and to secure the flag base 24 to the main base 23.

The flag base 24 has a protruding member 24B wherein the threaded hole 24A is located. The main base 23 has a protruding lip 23C that extends along an entire width of the main base 23. The protruding lip 23C acts as a shelf upon which the protruding member 24B of the flag base 24 can rest thereon.

The flag base 24 has a flag hole 22B located on a top surface of the flag base 24. The flag 11 has a flag pole 11A that is inserted into the flag hole 22B in order to secure the flag 11 to the flag base 24.

When fully assembled, the invention 10 hangs upon the basketball rim 60. The invention 10 can rotate back and forth thereon (see FIG. 6) wherein the flag 11 is impacted by a basketball 61. The weight of the assembly 21 will return the flag 11 to the vertical position by a self-ballasting effect produced by hanging a majority of the weight of the assembly 21 at or under the elevation of the basketball rim 60.

It shall be noted that the main base 23 shall hang along an internal side of the basketball rim 60; whereas the flag base 24 is located on an external side of the basketball rim 60. As previously mentioned, the main base 23 is countered by the flag base 24 such that the entire assembly 21 is balanced when hanging from the basketball rim 60.

The attaching means 31 comprises a bolt or screw. The assembly 21 is made of a material comprising a wood, plastic, metal, or carbon fiber composite.

Both the flag base 24 and the main base 23 have a pin hole 25A that align with one another when the invention 10 is fully assembled via the assembly 21. The pin holes 25A enable a pin 25B to pass there through and further secure the assembly 21. The pin 25B provides a second means of securing the assembly 21 at another location, which works in concert with the attaching means 31 that is located on a bottom portion of the assembly 21. The pin 25 is for use with an upper portion of the assembly 21.

The flag 11 has arms 11B that extend from side to side on the flag 21. The arms 11B are depicted and oriented from a forward and rear side with respect to the basketball rim 60. The arms 11B of the flag 11 do not counter-act against a ballast effect created with the assembly 21. However, it shall be noted that the arms 11B of the flag 11 may be oriented from a left and right side with respect to the basketball rim 60. The arms 11B extend from the flag 11 and act to form a "T" shape atop the assembly 21.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A Basketball free throw practice guide comprising:

a flag extending vertically from a flag base;

wherein an attaching means connects an assembly comprising a main base and flag base together;

wherein the main base has a groove that is enclosed via the flag base in which to encircle a portion of a cross-section of a basketball rim therein;

wherein the assembly can rotate about said basketball rim, and self-ballasts;

wherein the flag acts as a guide to teach proper basketball trajectory into said basketball rim;

wherein the flag has a thin profile, and includes arms that extend from side to side on the flag, and which are oriented from a forward and rear side with respect to the basketball rim.

2. The guide as described in claim 1 wherein the attaching means comprises a bolt or screw.

3. The guide as described in claim 1 wherein the flag has a flag pole that fits into a flag hole located on the flag base.

4. The guide as described in claim 1 wherein the main base and the flag base each have a threaded hole through which the attaching means enters into in order to secure the assembly together.

5. The guide as described in claim 4 wherein the flag base has a protruding member that extends thereon and includes the threaded hole thereon.

6. The guide as described in claim 5 wherein the main base has a protruding lip along a bottom of the main base.

7. The guide as described in claim 6 wherein the protruding member of the flag base rests upon the protruding lip of the main base; and wherein the threaded hole of the flag base and the main base align thereon.

8. The guide as described in claim 7 wherein the assembly when assembled and engaged upon a basketball rim, shall hang at or below the elevation of the basketball rim and act as a ballasting effect to automatically right the flag to a vertical position.

9. The guide as described in claim 8 wherein the main base shall hang along an internal side of the basketball rim; whereas the flag base shall be located on an external side of the basketball rim such that the main base is balanced with the flag base such that the entire assembly is counter-balanced when hanging from the basketball rim.

10. The guide as described in claim 1 wherein the main base and the flag base have a pin hole that are aligned with one another and of which a pin is inserted to further secure the assembly together in addition to the attaching means.

11. The guide as described in claim 1 wherein the flag has arms that extend atop said flag to form a "T' shape atop said assembly.

12. A Basketball free throw practice guide comprising:

a flag extending vertically from a flag base;

wherein an attaching means connects an assembly comprising a main base and flag base together;

wherein the main base has a groove that is enclosed via the flag base in which to encircle a portion of a cross-section of a basketball rim therein;

wherein the assembly can rotate about said basketball rim, and self-ballasts;

wherein the flag acts as a guide to teach proper basketball trajectory into said basketball rim;

wherein the flag has a flag pole that fits into a flag hole located on the flag base;

wherein the flag has arms that extend atop said flag;

wherein the main base and the flag base each have a threaded hole located on a bottom surface through which the attaching means enters into in order to secure the assembly together;

wherein the main base and the flag base have a pin hole that are aligned with one another and of which a pin is inserted to further secure the assembly together in addition to the attaching means;

wherein the flag has a thin profile, and includes arms that extend from side to side on the flag, and which are oriented from a forward and rear side with respect to the basketball rim.

13. The guide as described in claim 12 wherein the fastening means comprises a bolt or screw.

14. The guide as described in claim 12 wherein the flag base has a protruding member that extends thereon and includes the threaded hole thereon.

15. The guide as described in claim 14 wherein the main base has a protruding lip along a bottom of the main base; wherein the protruding member of the flag base rests upon the protruding lip of the main base.

16. The guide as described in claim 15 wherein the assembly when assembled and engaged upon a basketball rim, shall hang at or below the elevation of the basketball rim and act as a ballasting effect to automatically right the flag to a vertical position.

17. The guide as described in claim 16 wherein the main base shall hang along an internal side of the basketball rim; whereas the flag base shall be located on an external side of the basketball rim such that the main base is balanced with the flag base such that the entire assembly is counter-balanced when hanging from the basketball rim.

18. A Basketball free throw practice guide comprising:

a flag extending vertically from a flag base;

wherein an attaching means connects an assembly comprising a main base and flag base together;

wherein the main base has a groove that is enclosed via the flag base in which to encircle a portion of a cross-section of a basketball rim therein;

wherein the assembly can rotate about said basketball rim, and self-ballasts;

wherein the flag acts as a guide to teach proper basketball trajectory into said basketball rim;

wherein the flag has a flag pole that fits into a flag hole located on the flag base;

wherein the main base and the flag base each have a threaded hole through which the attaching means enters into in order to secure the assembly together;

wherein the main base shall hang along an internal side of the basketball rim; whereas the flag base shall be located on an external side of the basketball rim such that the main base is balanced with the flag base a such that the entire assembly is counter-balanced when hanging from the basketball rim;

wherein the main base and the flag base have a pin hole that are aligned with one another and of which a pin is inserted to further secure the assembly together in addition to the attaching means;

wherein the flag has a thin profile, and includes arms that extend from side to side on the flag, and which are oriented from a forward and rear side with respect to the basketball rim.

19. The guide as described in claim 18 wherein the attaching means comprises a bolt or screw.

20. The guide as described in claim 18 wherein the flag base has a protruding member that extends thereon and includes the threaded hole thereon; wherein the main base has a protruding lip along a bottom of the main base; wherein the protruding member of the flag base rests upon the protruding lip of the main base; and wherein the threaded hole of the flag base and the main base align thereon; wherein the assembly when assembled and engaged upon a basketball rim, shall hang at or below the elevation of the basketball rim and act as a ballasting effect to automatically right the flag to a vertical position.

* * * * *